US006621397B2

(12) United States Patent
Hsu

(10) Patent No.: US 6,621,397 B2
(45) Date of Patent: Sep. 16, 2003

(54) LOW PROFILE INDUCTOR

(75) Inventor: Han-Cheng Hsu, Taoyuan Hsien (TW)

(73) Assignee: Delta Electronics Inc., Taoyuan Sien (TW)

( * ) Notice: Subject to any disclaimer, the term of this patent is extended or adjusted under 35 U.S.C. 154(b) by 0 days.

(21) Appl. No.: 09/907,709

(22) Filed: Jul. 19, 2001

(65) Prior Publication Data

US 2002/0017972 A1 Feb. 14, 2002

(30) Foreign Application Priority Data

Aug. 14, 2000 (TW) ..... 89116306 A

(51) Int. Cl.[7] ..... H01F 27/02

(52) U.S. Cl. ..... 336/96; 336/192; 336/83; 29/602.1

(58) Field of Search ..... 336/200, 83, 223, 336/232, 192, 65, 96; 29/602.1

(56) References Cited

U.S. PATENT DOCUMENTS

,017,971 A * 2/1857 Koyama et al. ..... 336/83
4,483,724 A * 11/1984 Hasegawa ..... 420/121
4,553,123 A * 11/1985 Tamada et al. ..... 336/83
4,943,793 A * 7/1990 Ngo et al. ..... 336/83
5,296,830 A * 3/1994 Tamada et al. ..... 336/192
5,912,609 A * 6/1999 Usui et al. ..... 336/83
6,087,922 A * 7/2000 Smith ..... 336/223
6,114,932 A * 9/2000 Wester et al. ..... 336/65
6,252,487 B1 * 6/2001 Wolf et al. ..... 336/221

* cited by examiner

*Primary Examiner*—Anh Mai
(74) *Attorney, Agent, or Firm*—Birch, Stewart, Kolasch & Birch, LLP

(57) ABSTRACT

The present invention provides a low profile inductor and a method of making the same. First, a core seat including a cavity and two openings is provided. Then, a flat coil is embedded in the cavity of the core seat. The flat coil includes a first terminal and a second terminal extending outward or revealed by the openings so as to serving as the pins of the inductor. Further, a core cover is formed on the flat coil and the core seat.

21 Claims, 3 Drawing Sheets

LOW PROFILE INDUCTOR

BACKGROUND OF THE INVENTION

1. Field of the Invention

The present invention relates to an inductor, and more particularly to a low profile inductor and a method of making the same.

2. Description of the Prior Art

Generally, an inductor is one of the passive components used in the electrical devices. However, during seeking compact and light electrical devices, consideration of performance is unsatisfied. For example, although the volume of the inductor is reduced, the undesired DC resistance is inevitably increased.

Take a conventional inductor 10 shown in FIG. 1 as an example. The conventional inductor 10 includes a core 20 and a coil 30. Among these, the coil 30 is formed of the copper line wound around the outer surface of the core 20. Therefore, the total thickness of the conventional inductor 10 is the thickness of the core 20 plus two diameters of the copper line. That is, the total thickness of the conventional inductor 10 is larger than that of the core 20 obviously.

Stilling referring to FIG. 1, since the cross section of the copper line is round and conventional, the coil formed by winding occupies much of the volume of the inductor. Furthermore, the spaces formed between each of the turns of the coil increase the meaningless volume. Even though reducing the cross section area of the copper line, i.e. by reducing the diameter, the designer suffers the problem that the undesired DC resistance increases because the resistance is in inverse proportion to the cross section area. That is one of the reasons why the prior art fails to reduce the volume of the inductor. Therefore, there is a need in the art for reducing the volume of the inductor without increasing the DC resistant.

SUMMARY OF THE INVENTION

Consideration of the prior problems, the present invention provides a novel method for forming a low profile inductor by reducing volume and thickness.

The present invention provides a low profile inductor and a method of making the same. First, a core seat including a cavity and two openings is provided. Then, a flat coil is formed in the cavity of the core seat. The flat coil includes a first terminal and a second terminal extending outward or revealed by the openings so as to serving as the pins of the inductor. The extending directions of the first terminal and the second terminal are not parallel. A core cover is formed on the flat coil and the core seat for serving as a core of the inductor.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
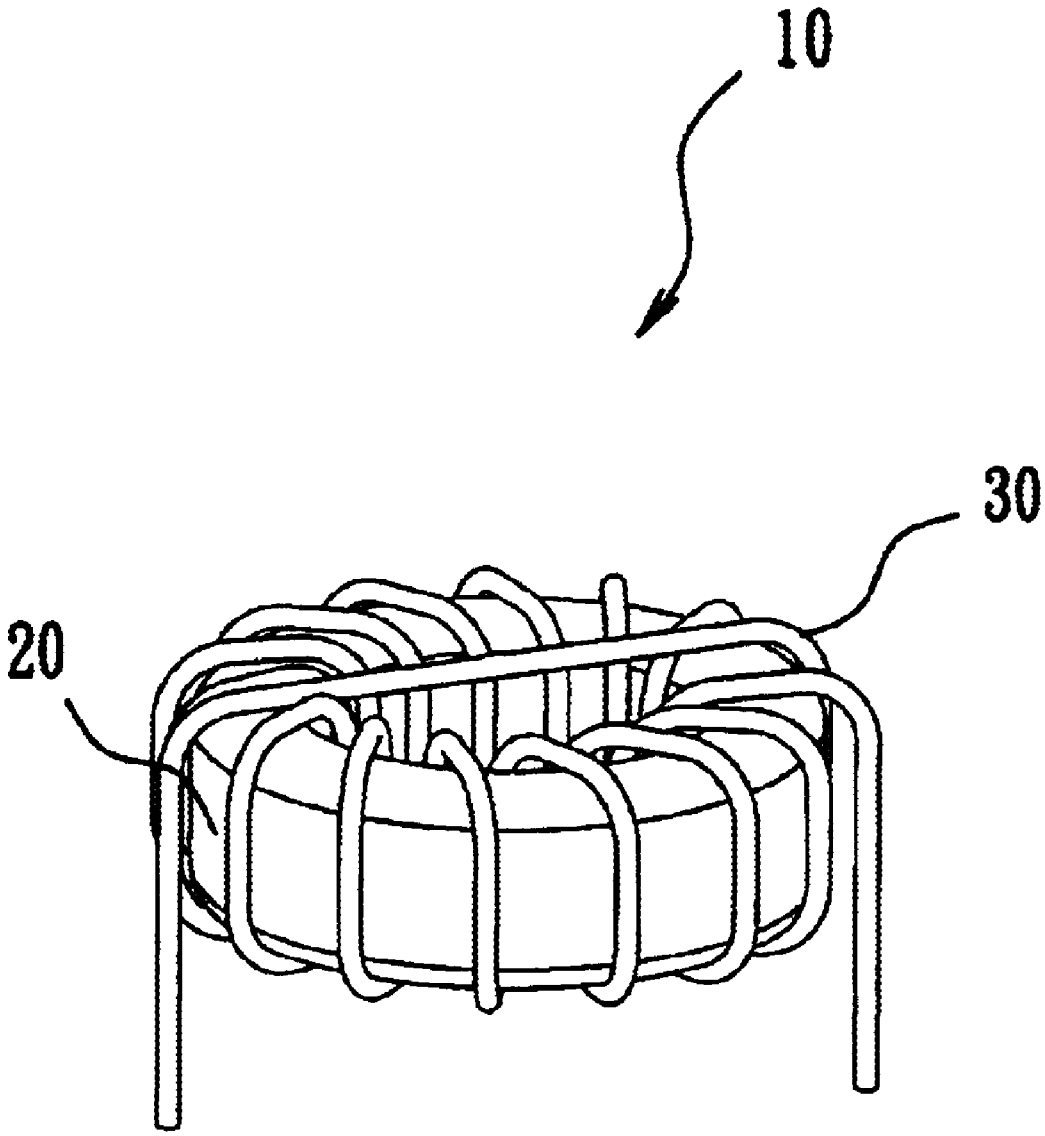
FIG. 1 shows a conventional inductor.
Figure 2:
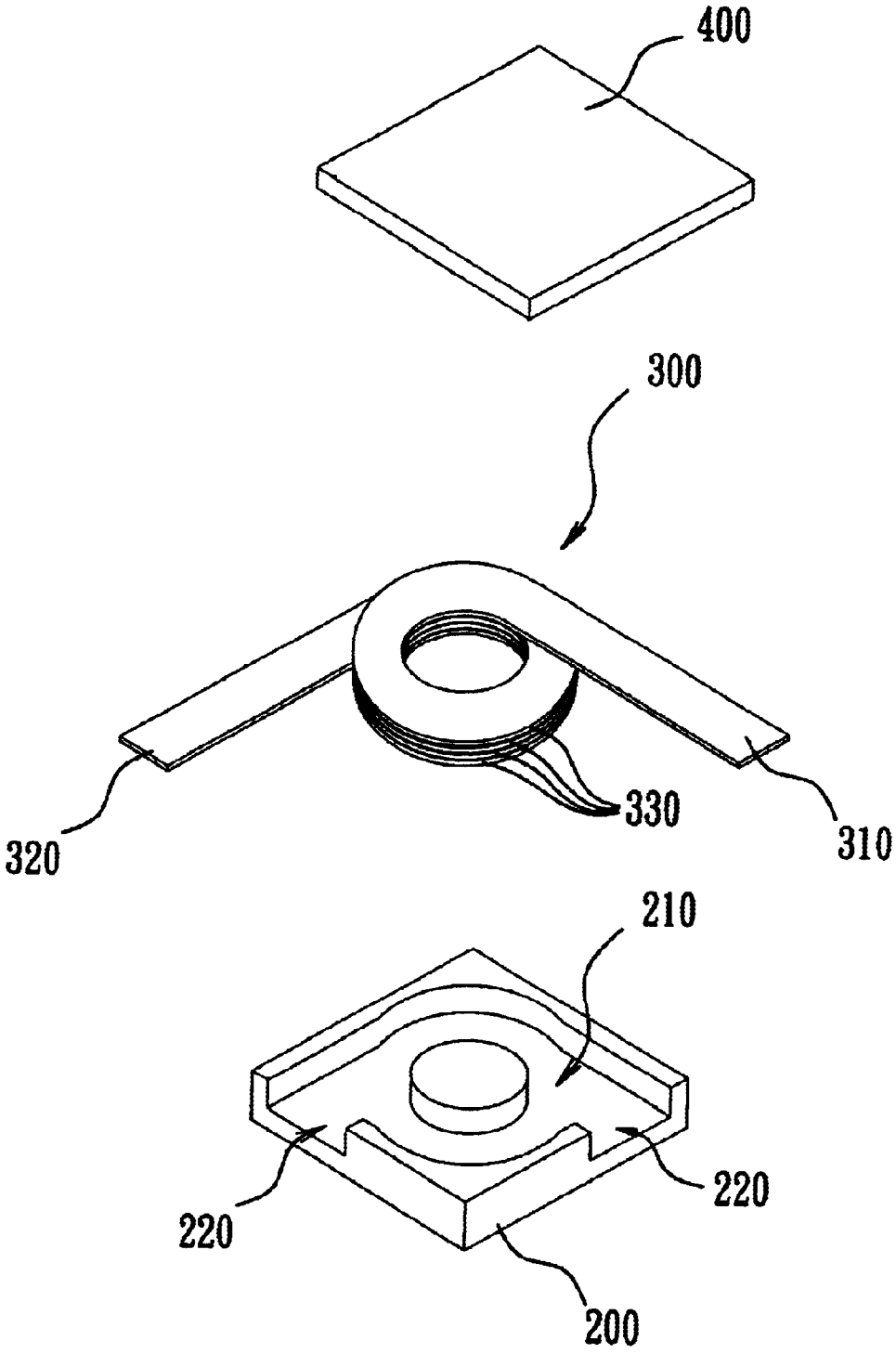
FIG. 2 shows an exploded view illustrating the inductor according to the present invention.

The present invention discloses a low profile inductor and a method of making the same. As shown in FIG. 2, the present inductor includes a core seat 200, a flat coil 300 and a core cover 400. The forming method includes the following steps. First, a core seat 200 is provided. The core seat 200 includes a cavity 210 and two openings 220. The openings 220 may be formed on the adjacent sidewalls, respectively. Alternatively, the core seat 200 is similar to a rectangular box having a bottom surface, four sidewalls and a cavity 210 for accommodating an object. Among these, each of the adjacent sidewalls has a respective opening 220.

Still referring to FIG. 2, then a flat coil 300 including a first terminal 310 and a second terminal 320 is formed in the cavity 210 of the core seat 200. The shape of the flat coil 300 closely meets that of the cavity 210. Therefore, the flat coil 300 is formed or embedded in the cavity 210 without generating space.

It is noted that since the flat coil 300 is formed in the cavity 210 of the core seat 200 rather than formed by winding around the surface of the core, it is permitted to previously form the flat coil 300 and then combine it with the core seat 200. Alternatively, it is possible to form the flat coil 300 and the core seat 200 synchronously. In this manner, the required producing time is reduced significantly relative to prior art.

Still referring to FIG. 2, it is noted that the flat coil 300 is formed of a wound inductive strip, coated with an insulating film, including a plurality of turns 330. Besides, each of the turns 330 is parallel to each other. The inductive strip is a flat, long and narrow. The cross section of the inductive strip is rectangular and has a width larger (e.g. 10 times) than thickness. Each of the turns 330 includes an upper surface and a lower surface. After winding, the lower surface of the upper turn 330 lies on and close to the upper surface of the lower turn 330. Therefore, it is substantially free of gap between the turns 330. If the thickness is t and the number of turns 330 is N, the thickness of the flat coil 300 is about tN. In one preferred embodiment, the thickness and the width of the inductive strip are 0.24 mm and 2.4 mm, respectively. However, the present invention is not limited to the specific dimension, other desired dimension also can be used.

Still referring to FIG. 2, in one embodiment, the extending directions of the first terminal 310 and the second terminal 320 are not parallel. For example, the extending direction of the first terminal 310 and that of the second terminal 320 may constitute an included angle having 90 degrees. In this case, two openings 220 are provided on the adjacent sidewalls so as to reveal the first terminal 310 and the second terminal 320,respectively. Of course, in the case that the extending direction of the first terminal 310 and that of the second terminal 320 constitute an included angle having 180 degrees, two openings 220 are formed on the opposite sidewalls.

Still referring to FIG. 2, a core cover 400 is further formed on the flat coil 200 and the core seat 300, and reveal the first terminal 310 and the second terminal 320 serving as the pins of the inductor. Both of the core seat 200 and the core cover 400 serve as a core of the inductor. In one preferred embodiment, the core seat 200 and the core cover 400 are made of iron-silicon alloy.

Figure 3:
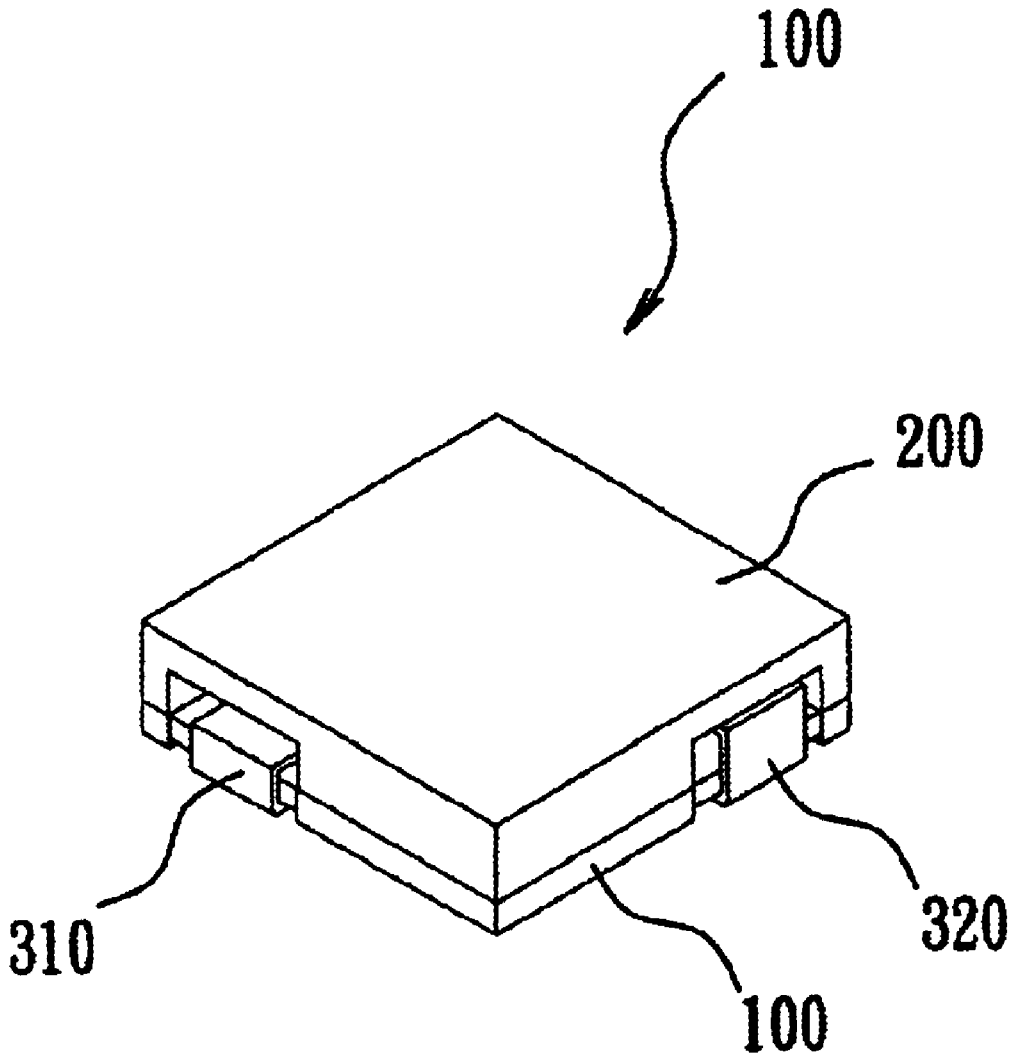
FIG. 3 shows a schematic view illustrating the inductor according to the present invention.

Still referring to FIG. 2, after the core seat 200 is combined with the flat coil 300 and the core cover 400, the present invention further performs the following step. The first terminal 310 and the second terminal 320 are bent toward the bottom surface of the core seat 200 so as to form the inductor 100 shown in FIG. 3. It is noted that the present inductor is a SMD (surface mounting device) and can be mounted on the board by SMT (surface mounting technology) rather than by hand. On the other hand, the inductor 100 can lie on the board due to the terminals on the bottom surface. In this embodiment, the inductor 100 has thickness of about 4 mm and thus has a low profile. Therefore, the present is applicable to the compact electrical devices.

In one preferred embodiment, the present inductor has an inductance between about 0.8 and 2.0 micro-Henry. Besides, the thickness, length and width are 4 mm, 12 mm and 12 mm, respectively, under the requirement for achieving maximum load current of 22 amperes and DC resistance between about 2.5 and 4.3 Ohms.

Obviously, the thickness of the present inductor 100 is less than that of the conventional inductor having the same inductance since the coil of the present inductor is formed by the improved winding method. For example, the cross section of the flat coil 300 is rectangular rather than round. Additionally, the flat coil is preformed and then embedded in the core seat 200 rather than wound around the surface of the core. Therefore, the present inductor 100 has a thickness identical to the thickness of the core seat 200 plus the thickness of the core cover 400. However, the thickness of the conventional inductor is inevitably larger than that of the conventional core.

As is understood by a person skilled in the art, the foregoing preferred embodiments of the present invention are illustrated of the present invention rather than limiting of the present invention. It is intended to core cover various modifications and similar arrangements included within the spirit and scope of the appended claims, the scope of which should be accorded the broadest interpretation so as to encompass all such modifications and similar structure.

What is claimed is:

1. A method for forming an inductor, comprising:

providing a core seat including a cavity and two openings, said openings formed on sidewalls of said core seat;

forming a flat coil in said cavity of said core seat, said flat coil including a first terminal and a second terminal, said first terminal and said second terminal extending outward or revealed by said openings so as to serving as pins of said inductor, wherein said first terminal and said second terminal extend toward different directions; and forming a core cover on said flat coil and said core seat, both of said core cover and said core seat serving as a core of said inductor.

2. The method according to claim 1, wherein said flat coil is formed of a wound inductive strip with a rectangular cross section, and said inductive strip comprises a plurality of parallel turns, and each of the turns includes an upper surface and a lower surface, and the lower surface of the upper turn is substantially close to said upper surface of the lower turn after said inductive strip is wound.

3. The method according to claim 1, wherein said inductive strip further comprises an insulating film coated thereon.

4. The method according to claim 1, wherein said cavity of said core seat closely meets a shape of said inductive strip.

5. The method according to claim 1, further comprises:

bending said first terminal and said second terminal toward a bottom surface of said core seat.

6. The method according to claim 1, wherein said core seat is made of iron-silicon alloy.

7. The method according to claim 1, wherein said core cover is made of iron-silicon alloy.

8. The method according to claim 1, wherein said openings are formed on the same sidewall of said core seat.

9. The method according to claim 1, wherein an extending direction of said first terminal and an extending direction of said second terminal constitute an included angle having 90 degrees.

10. A method for forming an inductor, comprising:

providing a core seat including a cavity and two openings, said openings formed on sidewalls of said core seat;

forming a flat coil in said cavity of said core seat, said flat coil being formed by winding an inductive strip at least one turn and in parallel, thickness of said flat coil being substantial the same to the product of thickness of said flat coil and turns of said flat coil, said flat coil including a first terminal and a second terminal, said first terminal and said second terminal being not parallel, said first terminal and said second terminal extending outward or revealed by said openings so as to serving as pins of said inductor; and forming a core cover on said flat coil and said core seat, both of said core cover and said core seat serving as a core of said inductor.

11. The method according to claim 10, wherein said inductive strip further comprising an insulating film coated thereon.

12. The method according to claim 10, wherein said cavity of said core seat closely meets a shape of said inductive strip.

13. The method according to claim 10, further comprises:

bending said first terminal and said second terminal toward a bottom surface of said core seat.

14. The method according to claim 10, wherein said core seat is made of iron-silicon alloy.

15. The method according to claim 10, wherein said core cover is made of iron-silicon alloy.

16. The method according to claim 10, wherein an extending direction of said first terminal and an extending direction of said second terminal constitute an included angle having 90 degrees.

17. The method according to claim 16, wherein said openings are formed on the same sidewall of said core seat.

18. An inductor, comprising:

a flat coil, said flat coil being formed by winding an inductive strip to form at least one parallel turn, a thickness of said flat coil being substantial the same to the product of a thickness of said flat coil and turns of said flat coil, said flat coil including a first terminal and a second terminal, said first terminal and said second terminal being not parallel, an extending direction of said first terminal and an extending direction of said second terminal being not parallel;

a core, further comprising:

a core seat including a cavity and two openings, said openings formed on sidewalls of said core seat, said first terminal and said second terminal extending outward or revealed by said openings so as to serving as pins of said inductor; and a core cover:

wherein said flat coil is formed in said cavity of said core seat and said core cover is formed on said flat coil and said core seat.

19. The inductor according to claim 18, wherein said inductive strip further comprises an insulating film coated thereon.

20. The inductor according to claim 18, wherein said cavity of said core seat closely meets a shape of said inductive strip.

21. The inductor according to claim 18, further comprising:

bending said first terminal and said second terminal toward a bottom surface of said core seat.

* * * * *